US006874989B2

(12) United States Patent
Kuramoto et al.

(10) Patent No.: US 6,874,989 B2
(45) Date of Patent: Apr. 5, 2005

(54) VACUUM PUMP

(75) Inventors: Satoru Kuramoto, Kariya (JP); Masahiro Kawaguchi, Kariya (JP); Shinya Yamamoto, Kariya (JP); Daisuke Sato, Kariya (JP); Osamu Uchiyama, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 23 days.

(21) Appl. No.: 10/658,155

(22) Filed: Sep. 8, 2003

(65) Prior Publication Data

US 2004/0047755 A1 Mar. 11, 2004

(30) Foreign Application Priority Data

Sep. 10, 2002 (JP) ..... 2002-264326

(51) Int. Cl.[7] ..... F04D 19/04

(52) U.S. Cl. ..... 415/119; 415/177; 415/214.1; 417/310; 417/440; 417/572

(58) Field of Search ..... 415/119, 175, 415/177, 178, 211.2, 214.1; 417/296, 310, 312, 440, 572

(56) References Cited

U.S. PATENT DOCUMENTS 4,549,857 A * 10/1985 Kropiwnicki et al. ..... 417/312
4,904,155 A 2/1990 Nagaoka et al. ..... 415/90
5,618,167 A * 4/1997 Hirakawa et al. ..... 415/90
5,762,478 A * 6/1998 Lee ..... 417/312
6,629,824 B2 * 10/2003 Yamauchi ..... 417/313
6,679,677 B2 * 1/2004 Yamauchi ..... 415/177

FOREIGN PATENT DOCUMENTS

JP 1-167497 7/1989 ..... F04D/19/04
JP 8-78300 3/1996 ..... H01L/21/02
JP 8-296557 11/1996 ..... F04B/37/18

* cited by examiner

*Primary Examiner*—F. Daniel Lopez
*Assistant Examiner*—Igor Kershteyn
(74) *Attorney, Agent, or Firm*—Morgan & Finnegan, LLP

(57) ABSTRACT

A vacuum pump has a housing and a pump mechanism accommodated in the housing. An exhaust-passage forming portion is located outside of the housing. The exhaust-passage forming portion forms an exhaust passage, which exhaust passage guides gas discharged from the pump mechanism toward the outside of the vacuum pump. A thermal conductor is connected to the outer surface of the exhaust-passage forming portion. The thermal conductor is made of a material having a thermal conductance of which is greater than that of the material for the exhaust-passage forming portion.

18 Claims, 5 Drawing Sheets

VACUUM PUMP

BACKGROUND OF THE INVENTION

The present invention relates to a vacuum pump which is used in, for example, a semiconductor fabrication process.

In a semiconductor fabrication process, a vacuum pump discharges a generated reaction product (gas) from a semiconductor process system. The vacuum pump has a housing where a pump mechanism is accommodated. An exhaust-passage forming portion to be connected to an exhaust-gas process system is protrusively provided outside the housing. The gas that has been exhausted from the pump mechanism is led to the exhaust-gas process system via an exhaust passage formed in the exhaust-passage forming portion.

As the exhaust-passage forming portion is not easily influenced by the heat from the pump mechanism and is thin, its temperature is lower than the temperature of the housing. Therefore, a reaction product discharged from the pump mechanism is cooled and solidified at the time it passes the exhaust-passage, and may adhere to the inner wall of the passage. If a large amount of a reaction product adheres to the inner wall of the exhaust passage, the adhered portion functions as the restriction of the gas passage, thus lowering the performance of the vacuum pump.

Particularly, that portion of the exhaust-passage forming portion which is located upstream of the gas passage is close to the connection position to the pump mechanism (the exhaust port of the pump mechanism), so that the portion is influenced by the heat and becomes relatively hot. Meanwhile, because that portion of the exhaust-passage forming portion which is located downstream of the gas passage is far from the connection position to the pump mechanism, its temperature becomes lower than the temperature of the upstream-side portion. Therefore, adhesion of a reaction product to the inner wall of the exhaust passage is more likely to occur at the downstream side portion than at the upstream side portion.

To overcome the problem, a technique of increasing the temperature at the portion where the solidification of a reaction product is likely to occur has been proposed. For instance, Japanese Laid-Open Patent Application No. 8-78300 discloses a technique which uses a heater to rise the temperature at the portion where the solidification of a reaction product is likely to occur (prior art 1).

Japanese Laid-Open Patent Application No. 8-296557 discloses a technique which efficiently transmits heat generated by the pump mechanism to the portion where the solidification of a reaction product is likely to occur by making the housing of an aluminum-based metal which has an excellent thermal conductance (prior art 2).

Japanese Laid-Open Patent Application No. 1-167497 discloses a technique of providing a heat pipe at the portion where the solidification of a reaction product is likely to occur (prior art 3).

The prior art involve the following problems.

In the case of the prior art 1, provision of a heater requires separate power supply equipment, which would lead to an increase in the equipment cost of the semiconductor fabrication process. In addition, the running cost would increase by the required generation of heat by the heater.

In the case of the prior art 2, a highly corrosive gas (e.g., ammonium chloride) is handled in the semiconductor fabrication process. Making the housing of an aluminum-based metal having a low corrosion resistance reduces the durability of the vacuum pump. Further, as the aluminum-based metal has a larger thermal expansion coefficient than, for example, an ion-based metal, the clearances of the individual sections may vary significantly, resulting in a possible gas leakage.

In the case of the prior art 3, an attempt to increase the thermal conductance of the heat pipe requires that the heat pipe should be made of an aluminum-based metal, brass or the like. This would bring about the same problem as that of the prior art 2. Because a gas flows in the hollow portion of the heat pipe, i.e., because the heat pipe forms the gas passage, the inside diameter or the like of the heat pipe should be processed accurately, resulting in a cost increase.

SUMMARY OF THE INVENTION

Accordingly, it is an object of the invention to provide a vacuum pump capable of increasing the temperature of the exhaust-passage forming portion by using the heat generated from the pump mechanism.

To achieve the above object, the present invention provides a vacuum pump. The vacuum pump has a housing, a pump mechanism, an exhaust-passage forming portion and a thermal conductor. The pump mechanism is accommodated in the housing. The exhaust-passage forming portion is located outside of the housing. The exhaust-passage forming portion forms an exhaust passage, which exhaust passage guides gas discharged from the pump mechanism toward the outside of the vacuum pump. The thermal conductor is connected to the outer surface of the exhaust-passage forming portion. The thermal conductor is made of a material having a thermal conductance of which is greater than that of the material for the exhaust-passage forming portion.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
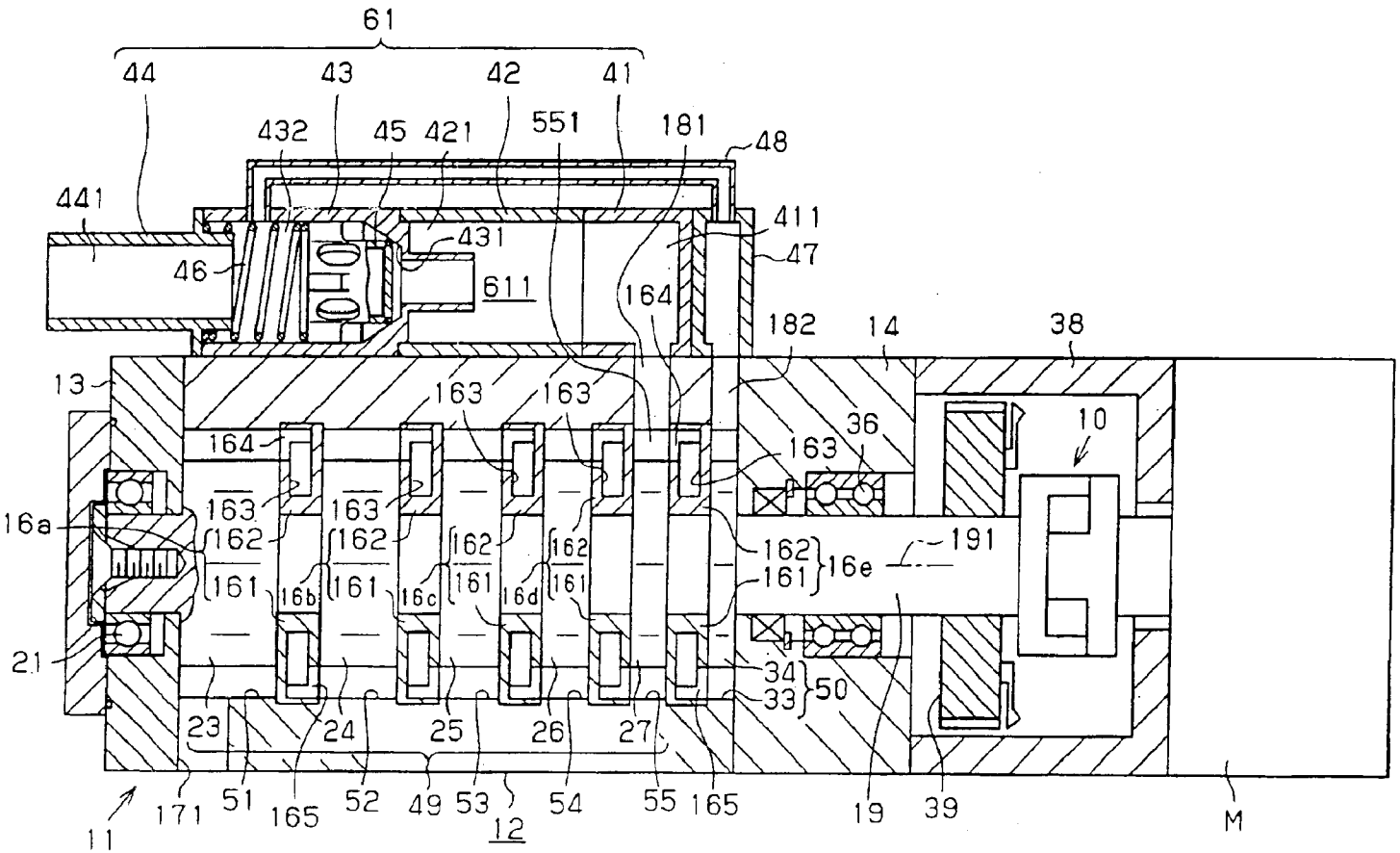
FIG. 1 is a cross-sectional view of a vacuum pump according to one embodiment of the present invention.

A description will be given of one embodiment of the invention as adapted to a multi-stage root pump 11 with reference to FIGS. 1 to 4. In FIG. 1, the left-hand side is the frontward of the multi-stage root pump 11 and the right-hand side is the rearward of the multi-stage root pump 11.

Figure 2:
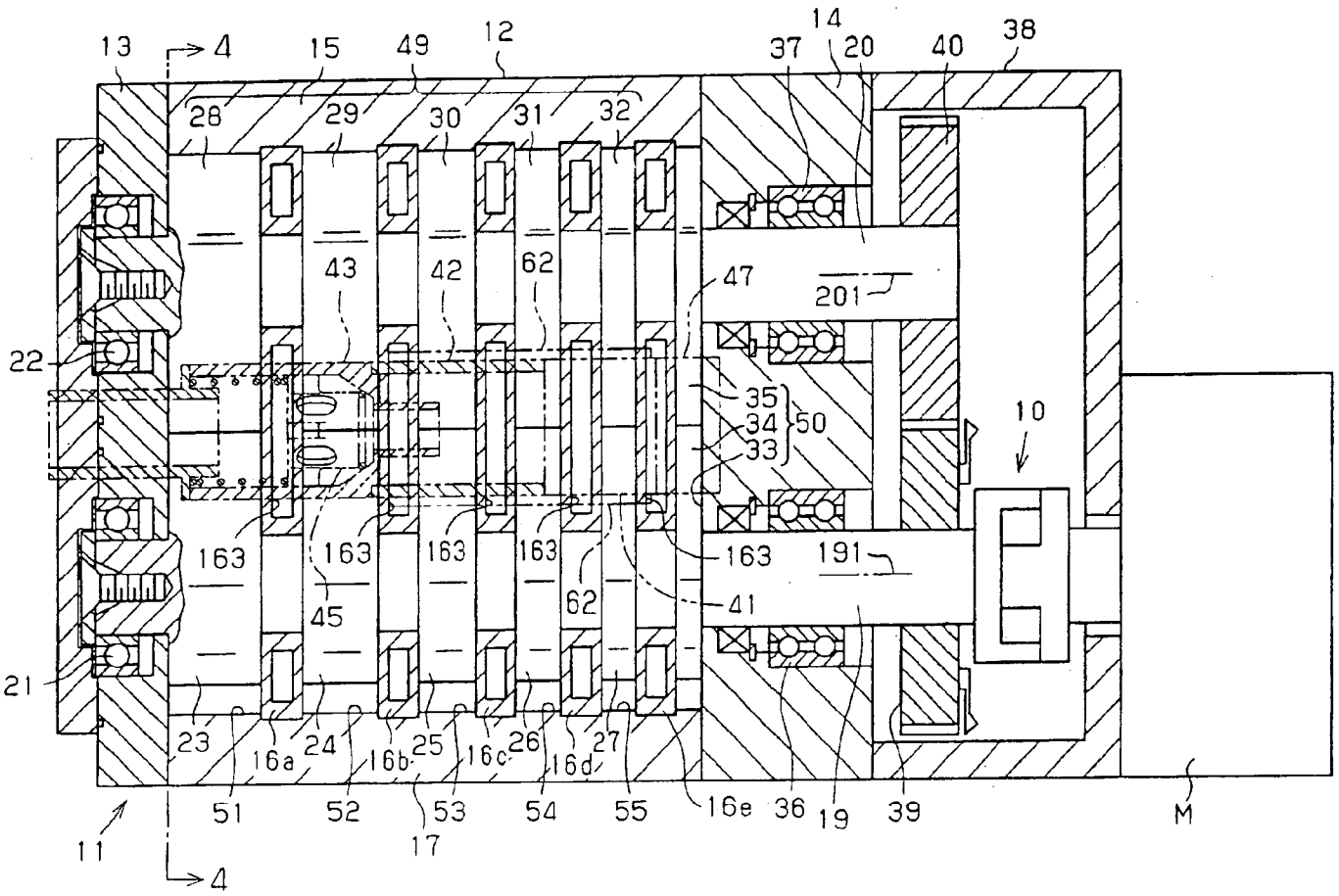
FIG. 2 is a horizontal cross-sectional view of the vacuum pump in FIG. 1.

As shown in FIGS. 1 and 2, a front housing member 13 is connected to the front end portion of a rotor housing member 12 of the multi-stage root pump 11 and a rear housing member 14 is connected to the rear end portion of the rotor housing member 12. The rotor housing member 12, the front housing member 13 and the rear housing member 14 constitute a housing which accommodates the pump mechanism of the multistage root pump 11.

The rotor housing member 12, the front housing member 13 and the rear housing member 14 are each made of an iron-based metal. Iron-based metals have smaller thermal expansion coefficients than, for example, an aluminum-based metal. The iron-based metals can therefore reduce heat-oriented variations in the clearances of the individual sections, which would be effective in preventing gas leakage or the like.

The pump mechanism will be elaborated next.

Figure 4:
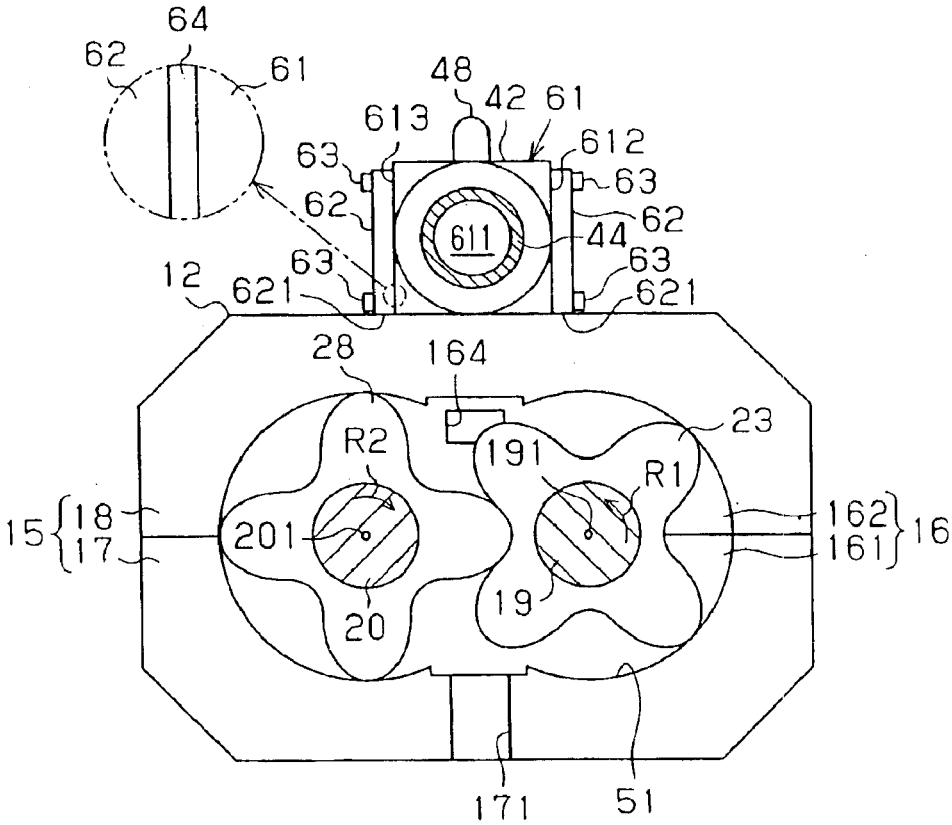
FIG. 4 is a cross-sectional view along the line 4—4 in FIG. 2.

As shown in FIGS. 1 and 2, the rotor housing member 12 includes a cylinder block 15 and first to fifth partition walls 16*a*, 16*b*, 16*c*, 16*d* and 16*e*. First to fifth pump chambers 51, 52, 53, 54 and 55 are respectively defined in the space between the front housing member 13 and the first partition wall 16*a*, the space between the first and second partition walls 16*a* and 16*b*, the space between the second and partition walls 16*b* and 16*c*, the space between the third and fourth partition walls 16*c* and 16*d*, and the space between the fourth and fifth partition walls 16*d* and 16*e*. The first to fifth pump chamber, 51, 52, 53, 54 and 55 function as a main pump chamber. A sixth pump chamber 33 is defined in the space between the fifth partition wall 16*e* and the rear housing member 14. The sixth pump chamber 33 serves as an auxiliary pump chamber. As shown in FIG. 4, the cylinder block 15 includes a pair of block pieces 17 and 18 and each of the five partition walls 16*a*, 16*b*, 16*c*, 16*d* and 16*e* includes a pair of wall pieces 161 and 162.

As shown in FIG. 2, a first rotary shaft 19 is rotatably supported on the front housing member 13 and the rear housing member 14 via first and second radial bearings 21 and 36. A second rotary shaft 20 is rotatably supported on the front housing member 13 and the rear housing member 14 via third and fourth radial bearings 22 and 37. Both rotary shafts 19 and 20 are laid out in parallel to each other. The rotary shafts 19 and 20 are inserted into the first to fifth partition walls 16a to 16*e*.

Five rotors or first to fifth rotors 23, 24, 25, 26 and 27 are formed integrally on the first rotary shaft 19. The same number of rotors or sixth to tenth rotors 28, 29, 30, 31 and 32 are formed integrally on the second rotary shaft 20. The first to tenth rotors 23 to 32 serve as a main rotor. An eleventh rotor 34 is formed integrally on the first rotary shaft 19. A twelfth rotor 35 is formed integrally on the second rotary shaft 20. The first to tenth rotors 23 to 32 have the same shape and the same size as the first and second auxiliary rotors 34 and 35 as seen from the direction of axial lines 191 and 201 respectively corresponding to the first and second rotary shafts 19 and 20. The thickness of the first to fifth rotors 23 to 27 in the axial direction of the first rotary shaft 19 become gradually smaller in the direction from the first rotor 23 toward the fifth rotor 27. Likewise, the thickness of the sixth to tenth rotors 28 to 32 in the axial direction of the second rotary shaft 20 become gradually smaller in the direction from the sixth rotor 28 toward the tenth rotor 32. The thickness of the eleventh rotor 34 in the axial direction of the first rotary shaft 19 is smaller than the thickness of the fifth rotor 27 in the same direction. The thicknesses of the twelfth rotor 35 in the axial direction of the second rotary shaft 20 is smaller than the thickness of the tenth rotor 32 in the same direction.

The first and sixth rotors 23 and 28 are retained in engagement with each other in the first pump chamber 51 with a slight clearance maintained. The second and seventh rotors 24 and 29 are likewise retained in engagement with each other in the second pump chamber 52 with a slight clearance maintained. Likewise, the third and eighth rotors 25 and 30 are retained in engagement with each other in the third pump chamber 53 with a slight clearance maintained, the fourth and ninth rotors 26 and 31 are retained in engagement with each other in the fourth pump chamber 54 with a slight clearance maintained, and the fifth and tenth rotors 27 and 32 are retained in engagement with each other in the fifth pump chamber 55 with a slight clearance maintained. The eleventh and twelfth rotors 34 and 35 are retained in engagement with each other in the sixth pump chamber 33 with a slight clearance maintained. The volumes of the first to fifth pump chambers 51 to 55 become gradually smaller in order from the first pump chamber 51 toward the fifth pump chamber 55. The volume of the sixth pump chamber 33 is smaller than the volume of the fifth pump chamber 55.

The first to fifth pump chambers 51 to 55 and the first to fifth rotors 23 to 27 constitute a main pump 49. The sixth pump chamber 33 and the eleventh and twelfth rotors 34 and 35 constitute a sub pump 50 which has a smaller exhaust capacity than the main pump 49. The main pump 49 and the sub pump 50 constitute the pump mechanism of the multi-stage root pump 11. As shown in FIG. 1, part of the fifth pump chamber 55 is defined by the fifth and tenth rotors 27 and 32 as a quasi-exhaust chamber 551 which communicates with a main exhaust port 181.

As shown in FIG. 2, a gear housing 38 is connected to the rear housing member 14. Both rotary shafts 19 and 20 penetrate the rear housing member 14 and protrude into the gear housing 38, with first and second gears 39 and 40 secured to the respective protruding end portions of the rotary shafts 19 and 20 in engagement with each other. An electric motor M is mounted on the gear housing 38. The driving force of the electric motor M is transmitted to the first rotary shaft 19 via a first shaft coupling 10. The first rotary shaft 19 is rotated in a direction of an arrow R1 in FIG. 4 by the driving force of the electric motor M. The driving force of the electric motor M is transmitted to the second rotary shaft 20 via the first and second gears 39 and 40. The second rotary shaft 20 rotates in a direction of an arrow R2 in FIG. 4, reverse to the rotational direction of the first rotary shaft 19.

A passage 163 is formed in each of the partition walls 16*a*, 16*b*, 16*c*, 16*d* and 16*e*. An inlet 164 to the passage 163 and an outlet 165 from the passage 163 are formed in each of the partition walls 16*a* to 16*e*. Adjoining ones of the first to fifth pump chambers 51, 52, 53, 54 and 55 communicate with each other via the passage 163. The fifth pump chamber 55 and the sixth pump chamber 33 communicate with each other via the passage 163 of the fifth partition wall 16*e*.

As shown in FIGS. 1 and 4, a suction port 171 is formed in the first block piece 17 in such a way as to communicate with the first pump chamber 51. The exhaust pipe of an unillustrated semiconductor process system is connected to the suction port 171. The main exhaust port 181 is formed in the second block piece 18 in such a way as to communicate with the fifth pump chamber 55. As the first and sixth rotors 23 and 28 rotate, a gaseous reaction product (e.g., ammonium chloride as a gas) which has been led into the first pump chamber 51 from the suction port 171 enters the passage 163 from the inlet 164 of the first partition wall 16*a* and is transferred to the adjoining second pump chamber 52 from the outlet 165.

The gas is likewise transferred to the second pump chamber 52, the third pump chamber 53, the fourth pump chamber 54 and the fifth pump chamber 55 in order. The gas that has been transferred to the fifth pump chamber 55 is discharged out of the rotor housing member 12 through the main exhaust port 181.

A sub exhaust port 182 is formed in the second block piece 18 in such a way as to communicate with the sixth pump chamber 33. As the eleventh and twelfth rotors 34 and 35 rotate, a part of the gas in the fifth pump chamber 55 enters the passage 163 from the inlet 164 of the fifth partition wall 16*e* and is transferred to the adjoining sixth pump chamber 33 from the outlet 165. The gas that has been transferred to the sixth pump chamber 33 is discharged out of the rotor housing member 12 through the sub exhaust port 182.

The exhaust-side gas passage of the multi-stage root pump 11 will be discussed below.

Figure 3:
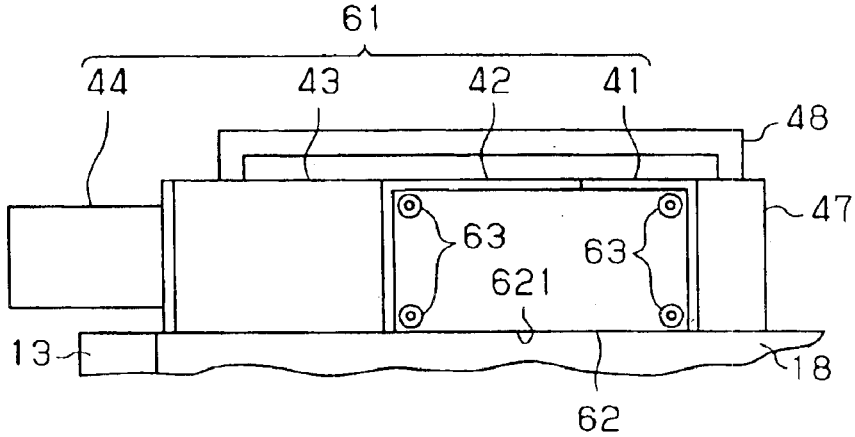
FIG. 3 is a side view showing the essential portions of the vacuum pump in FIG. 1.

As shown in FIGS. 1, 3 and 4, a first exhaust flange 41 is securely connected to the outer surface of the second block piece 18 in the cylinder block 15 at a position closer to the rear housing member 14. A space portion 411 in the first exhaust flange 41 communicates with the main exhaust port 181 of the main pump 49. A muffler 42 is securely connected to the first exhaust flange 41 on the outer surface of the second block piece 18. The muffler 42 extends from the exhaust flange 41 to the front housing member 13 in parallel to the rotational axes of both rotary shafts 19 and 20. To guarantee the corrosion resistance to a corrosive gas, the first exhaust flange 41 and the muffler 42 are made of ion-based metals. The first exhaust flange 41 and the muffler 42 have parallelepiped shapes and protrude from the outer surface of the second block piece 18.

Although the first exhaust flange 41 and the muffler 42 are separate from the second block piece 18 in the embodiment, at least a part of the first exhaust flange 41 and/or at least a part of the muffler 42 may be formed integral with the second block piece 18.

A guide pipe 43 is fitted in the front end portion of the muffler 42. An exhaust pipe 44 is fixed to the front end portion of the guide pipe 43. The unillustrated exhaust-gas process system which processes a gas is connected to the exhaust pipe 44. The guide pipe 43 and the exhaust pipe 44 are made of stainless steel excellent in corrosion resistance.

The space portion 411 in the first exhaust flange 41, a space portion 421 in the muffler 42, a space portion 432 in the guide pipe 43 and a space portion 441 in the exhaust pipe 44 constitute an exhaust passage 611 for sending the gas, discharged from the main exhaust port 181 of the main pump 49, toward the exhaust-gas process system. That is, the first exhaust flange 41, the muffler 42, the guide pipe 43 and the exhaust pipe 44 function as an exhaust-passage forming portion 61 protrusively provided on the outer surfaces of the housing members 12 to 14 of the multi-stage root pump 11.

A valve body 45 and a return spring 46 are retained in the space portion 432 of the guide pipe 43. A tapered valve hole 431 is formed in the space portion 432 of the guide pipe 43. The valve body 45 opens and closes the valve hole 431. The return spring 46 urges the valve body 45 toward a position to close the valve hole 431. The guide pipe 43, the valve body 45 and the return spring 46 prevent the gas on that side of the exhaust pipe 44 from flowing reversely toward the muffler 42.

A second exhaust flange 47 is connected to the sub exhaust port 182. A sub exhaust pipe 48 is connected to the second exhaust flange 47. The sub exhaust pipe 48 is also connected to the guide pipe 43. The position of connection of the sub exhaust pipe 48 and the guide pipe 43 is downstream of the positions where the valve hole 431 is opened and closed by the valve body 45.

As the electric motor M is activated, both rotary shafts 19 and 20 rotate, allowing the gas in the semiconductor process system to be led into the first pump chamber 51 of the main pump 49 via the suction port 171. The gas sucked into the first pump chamber 51 of the main pump 49 is moved toward the second to fifth pump chambers 52 to 55 while being compressed. In the case where the gas flow rate is high, most of the gas transferred to the fifth pump chamber 55 is discharged to the exhaust passage 611 from the main exhaust port 181 and part of the gas is discharged into the second exhaust flange 47 from the sub exhaust port 182 by the action of the sub pump 50 and is merged into the exhaust passage 611 at the downstream side of the valve body 45 from the second exhaust flange 47 via the sub exhaust pipe 48.

As apparent from the above, the provision of the sub pump 50 can reduce the pressure on the exhaust side of the main pump 49. It is therefore possible to prevent the gas at the upstream of the opening/closing positions of the valve body 45 in the exhaust passage 611 from flowing reversely to the fifth pump chamber 55 of the main pump 49. This can decrease the power loss of the multi-stage root pump 11.

A description will now be given of the structure that prevents the solidification of a reaction product in the exhaust passage 611.

As mentioned in the foregoing section "BACKGROUND OF THE INVENTION", since the exhaust-passage forming portion 61 is not easily influenced by the heat generated from the main pump 49 and is thin itself, its temperature is likely to become lower than the temperatures of the housing members 12 to 14. It is therefore probable that the reaction product discharged from the main pump 49 is cooled and solidified at the time it passes the exhaust passage 611. The purpose of forming the exhaust-passage forming portion 61 thin is to reduce the thickness of the exhaust-passage forming portion 61 which does not influence on rigidity of the housing members 12 to 14, thereby making the multi-stage root pump 11 lighter.

Particularly, because the upstream portion in the gas passage in the exhaust-passage forming portion 61 (the portion in the vicinity of the first exhaust flange 41) is close to the main exhaust port 181 or the position of connection to the main pump 49, the portion is influenced by the heat and becomes relatively hot, whereas the downstream portion (the portion in the vicinity of the guide pipe 43 and the exhaust pipe 44) is far from the main exhaust port 181 of the main pump 49, its temperature is apt to become lower than the temperature of the upstream portion. Therefore, the solidification of a reaction product in the exhaust passage 611 is easier to occur at the downstream portion than at the upstream portion.

As shown in FIGS. 3 and 4, a thermal conductor 62 is securely connected to the outer surface of the exhaust-passage forming portion 61 according to the embodiment. The thermal conductor 62 is made of a metal (e.g., an aluminum-based metal or brass) whose thermal conductance is larger than that of the material (ion-based metal) for the exhaust-passage forming portion 61. The thermal conductor 62 has the shape of a flat rectangular plate and is so arranged as to cover the rectangular area extending from the exhaust flange 41 to the muffler 42 at a part (612, 613) of the outer surface of the exhaust-passage forming portion 61. An end face 621 of the thermal conductor 62 abuts on the outer surfaces of the housing members 12 to 14 (the outer surface of the second block piece 18). The thermal conductor 62 is secured to the exhaust-passage forming portion 61 by metal bolts 63.

As shown in FIG. 4, the thermal conductor 62 is attached to both sides 612 and 613 of the parallelepiped portion of the exhaust-passage forming portion 61 (the first exhaust flange 41 and the muffler 42) in the lengthwise direction. The two thermal conductors 62 hold the exhaust-passage forming portion 61 at the lengthwise sides of the exhaust passage 611. As indicated by an enlarged circle in FIG. 4, a thermal conductive grease 64 as thermal-conductance improver is intervened at the portion where the exhaust-passage forming portion 61 and the thermal conductor 62 are connected together in order to enhance the adhesion between both components 61 and 62 or the thermal conductance. The thermal conductive grease 64 is located between the thermal conductor 62 and the exhaust-passage forming portion 61 such that a gap does not exist between the thermal conductor and the exhaust-passage forming portion. A silicone grease, for example, is available as the thermal conductive grease 64.

As the thermal conductors 62 are securely connected to the outer surface of the exhaust-passage forming portion 61 this way, the heat at the upstream portion of the exhaust-passage forming portion 61 (the portion in the vicinity of the first exhaust flange 41) is efficiently transmitted to the downstream portion (the portion in the vicinity of the guide pipe 43 and the exhaust pipe 44) via the thermal conductors 62. Therefore, the temperature of the downstream portion of the exhaust-passage forming portion 61 can be made higher as compared with, for example, the case where the thermal conductors 62 are not provided, thereby making it possible to prevent a reaction product from being solidified in the exhaust passage 611 corresponding to the downstream portion. This can prevent a reduction in the performance of the multi-stage root pump 11 which would otherwise be caused by the adhesion of a large amount of a reaction product to the inner wall of the exhaust passage 611.

The present embodiment has the following advantages.

Securely connecting the thermal conductors 62 to the outer surface of the exhaust-passage forming portion 61 prevents the solidification of a reaction product in the exhaust passage 611 corresponding to the downstream portion of the exhaust-passage forming portion 61. This scheme of increasing the temperature of the downstream portion of the exhaust-passage forming portion 61 by using the heats generated from both pumps 49 and 50 requires no power supply equipment that would be needed, for example, in the case of providing the exhaust-passage forming portion 61 with a heater, thereby ensuring suppression of the equipment cost and running cost of the semiconductor fabrication process. As the thermal conductors 62 are separate from the exhaust-passage forming portion 61, the degree of freedom of choosing the material for the exhaust-passage forming portion 61 (the inner wall of the exhaust passage 611) increases. It is therefore possible to prevent the durability of the multi-stage root pump 11 from being lowered by making the exhaust-passage forming portion 61 of a material excellent in corrosion resistance.

As apparent from the above, the embodiment can both satisfy both the prevention of the solidification of a reaction product using the heats generated from the pumps 49 and 50 and the prevention of a reduction in the durability of the multi-stage root pump 11. Therefore, the multi-stage root pump 11 becomes particularly suitable for use in a semiconductor fabrication process.

The thermal conductors 62 are securely fixed to the outer surface of the exhaust-passage forming portion 61 which will not be exposed to the gas passage, thus eliminating the need for high-precision processing that would be needed for a heat pipe which is exposed to the gas passage or which constitutes the gas passage. It is therefore possible to produce the thermal conductors 62 at a low cost, thus contributing to reducing the manufacturing cost of the multi-stage root pump 11.

It is easy to produce the flat thermal conductors 62 and to attach the thermal conductors 62 to the exhaust-passage forming portion 61. This makes it easier to adapt the structure of preventing the solidification of a reaction product to the multi-stage root pump 11.

The end face 621 of the thermal conductor 62 abuts on the outer surfaces of the housing members 12 to 14 (the outer surface of the second block piece 18). Therefore, the heat in the vicinity of the main exhaust port 181 is directly transmitted to the thermal conductor 62 from the second block piece 18. This makes it possible to efficiently increase the temperature at the downstream portion of the exhaust-passage forming portion 61, thereby reliably preventing the solidification of a reaction product in the exhaust passage 611.

The thermal conductor 62 is secured to the exhaust-passage forming portion 61 by the metal bolts 63. The distal ends of the bolts 63 are fastened into the exhaust-passage forming portion 61 so that the thermal conductor 62 is coupled to not only the outer surface of the exhaust-passage forming portion 61 but also the interior thereof via the bolts 63. The thermal conductance between the exhaust-passage forming portion 61 and the thermal conductor 62 is therefore improved to be able to efficiently raise the temperature at the downstream portion of the exhaust-passage forming portion 61. This surely prevents the solidification of a reaction product in the exhaust passage 611.

As the thermal conductive grease 64 is intervened between the exhaust-passage forming portion 61 and the thermal conductor 62, the thermal conductance between both components 61 and 62 is improved. This can ensure efficient heat transmission to the thermal conductor 62 from the upstream portion of the exhaust-passage forming portion 61 and efficient heat transmission to the downstream portion of the exhaust-passage forming portion 61 from the thermal conductor 62, making it possible to efficiently increase the temperature at the downstream portion. This surely prevents the solidification of a reaction product in the exhaust passage 611.

The two thermal conductors 62 hold the exhaust-passage forming portion 61 at both sides of the exhaust passage 611 in the lengthwise direction thereof. Therefore, the heat at the upstream portion of the exhaust-passage forming portion 61 can be efficiently transmitted to the downstream portion thereof, ensuring raising of the temperature at the downstream portion.

It should be apparent to those skilled in the art that the present invention may be embodied in many other specific forms without departing from the spirit or scope of the invention. Particularly, it should be understood that the invention may be embodied in the following forms.

Figure 5:
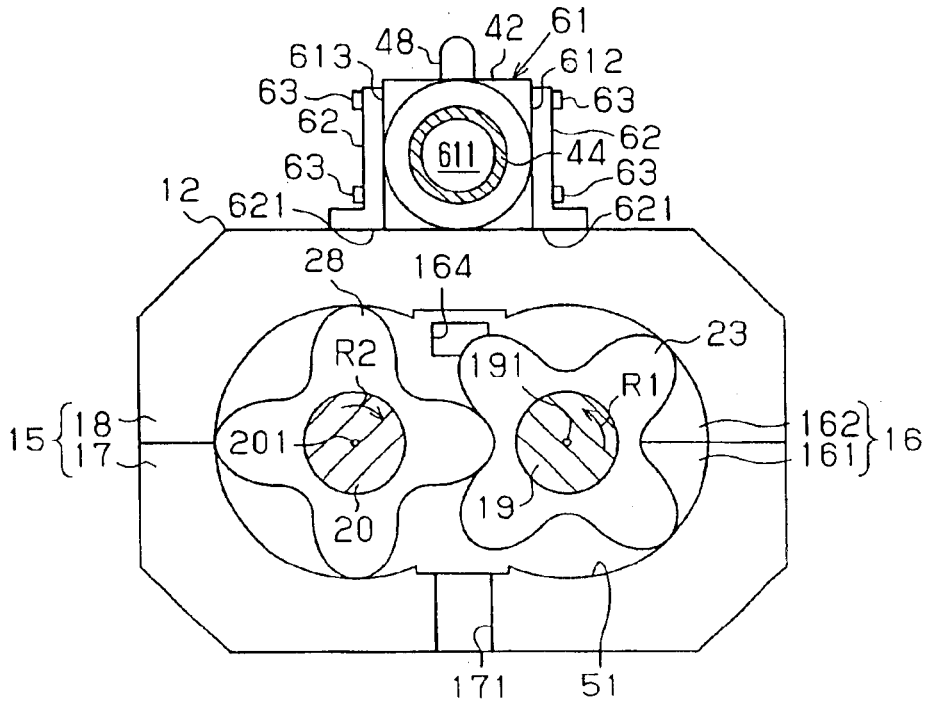
FIG. 5 is a cross-sectional view of a vacuum pump according to another embodiment.

Two thermal conductors 62 that have an L-shaped cross section and are formed by bending a flat plate may be provided as shown in FIG. 5. In this embodiment, the thermal conductors 62 can be attached to the exhaust-passage forming portion 61 easily. It is to be noted however that the area of contact of the end face 621 of the thermal conductor 62 to the outer surfaces of the housing members 12 to 14 (specifically, the outer surface of the second block piece 18) becomes larger than the embodiment in FIG. 3. This increases the thermal conductance between the thermal conductor 62 and the second block piece 18.

Figure 6:
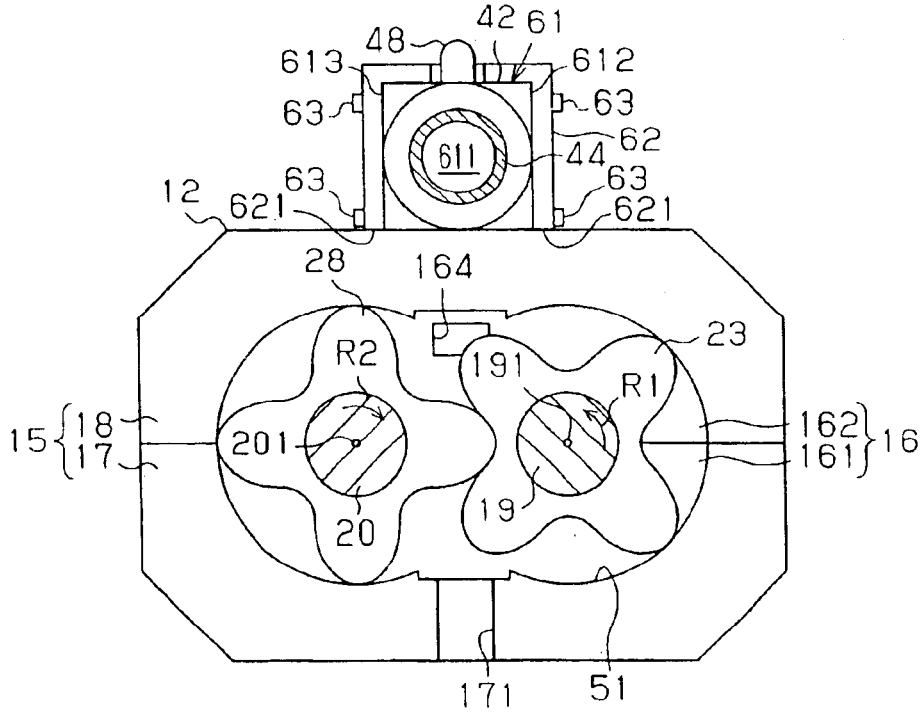
FIG. 6 is a cross-sectional view of a vacuum pump system according to a different embodiment.

A thermal conductor 62 with a U-shaped cross section may be provided as shown in FIG. 6. The thermal conductor 62 is laid out in such a way as to hold the exhaust-passage forming portion 61 at the lengthwise sides of the exhaust passage 611. From another point of view, the exhaust-passage forming portion 61 is covered with the single thermal conductor 62. The use of the single thermal conductor 62 facilitates the handling of the thermal conductor 62 at the time of assembling the multi-stage root pump 11, thus simplifying the assembling process.

In the embodiment shown in FIGS. 1 to 4, the thermal conductor 62 may be made greater or multiple thermal conductors 62 may be used so that the thermal conductor 62 or thermal conductors 62 are connected to the guide pipe 43 and/or the exhaust pipe 44. In this case, as the guide pipe 43 and the exhaust pipe 44 have circular outer shapes, it is necessary to curve the thermal conductor 62, which is to be connected to the associated outer surface, in such a way as to have an arcuate cross section. This design can allow the heat of the thermal conductor 62 to be transmitted directly to the guide pipe 43 and/or the exhaust pipe 44, making it possible to raise the temperature at the downstream portion of the exhaust-passage forming portion 61 more efficiently.

Figure 7:
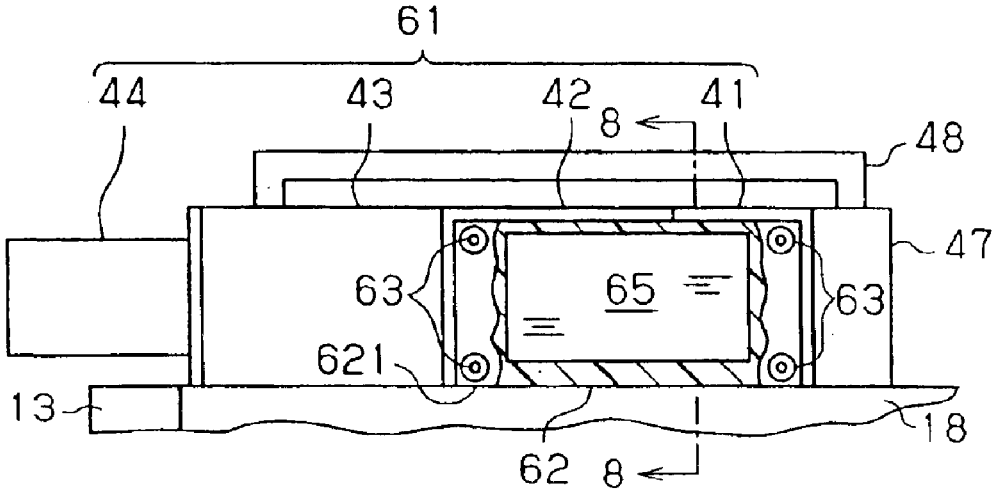
FIG. 7 is a side view showing the essential portions of a vacuum pump system according to a further embodiment.
Figure 8:
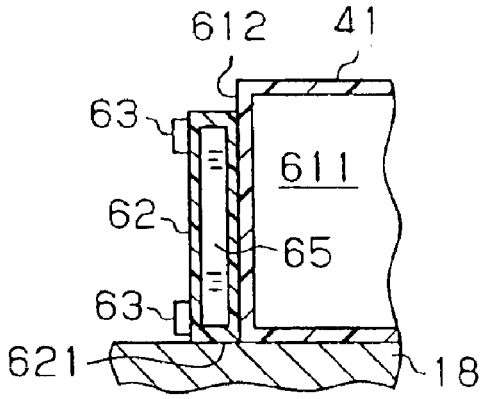
FIG. 8 is a cross-sectional view along the line 8—8 in FIG. 7.

The thermal conductor is not limited to a solid type, but may be a liquid. As shown in FIGS. 7 and 8, for example, at least one of the first exhaust flange 41 and the muffler 42 in the exhaust-passage forming portion 61 may be made of a resin material. The thermal conductor 62 of FIGS. 1 to 4 may be hollow and made of a resin material. A thermal conductor 65 made of a liquid (e.g., mercury) that has a greater thermal conductance than the resin material for the exhaust-passage forming portion 61 may be sealed in the space of the thermal conductor 62.

The thermal conductive grease 64 in the embodiment in FIGS. 1 to 4 may be replaced with a copper paste, a resin sheet or a rubber sheet which is intervened at the portion where the exhaust-passage forming portion 61 and the thermal conductor 62 are connected together.

The invention may be adapted to other vacuum pumps (e.g., a screw pump) than a root type.

The present examples and embodiments are to be considered as illustrative and not restrictive and the invention is not to be limited to the details given herein, but may be modified within the scope and equivalence of the appended claims.

What is claimed is:

1. A vacuum pump comprising:

a housing;

a pump mechanism accommodated in the housing;

an exhaust-passage forming portion located outside of the housing, wherein the exhaust-passage forming portion forms an exhaust passage, which exhaust passage guides gas discharged from the pump mechanism toward the outside of the vacuum pump; and a thermal conductor connected to an outer surface of the exhaust-passage forming portion, wherein the thermal conductor is made of a material having a thermal conductance that is greater than that of the material for the exhaust-passage forming portion.

2. The pump according to claim 1, wherein the thermal conductor is shaped as a flat plate.

3. The pump according to claim 1, wherein the thermal conductor is formed by bending a flat plate.

4. The pump according to claim 1, wherein a thermal-conductance improver is located between the thermal conductor and the exhaust-passage forming portion.

5. The pump according to claim 4, wherein the thermal-conductance improver is located between the thermal conductor and the exhaust-passage forming portion such that a gap does not exist between the thermal conductor and the exhaust-passage forming portion.

6. The pump according to claim 1, wherein the thermal conductor extends parallel to the direction in which the exhaust passage extends, and holds the exhaust-passage forming portion.

7. The pump according to claim 1, wherein the gas is a gaseous reaction product generated in a semiconductor fabrication process.

8. The pump according to claim 1, wherein the thermal conductor is fixed to the exhaust-passage forming portion with a metal bolt.

9. The pump according to claim 1, wherein the thermal conductor abuts on an outer surface of the housing.

10. A vacuum pump comprising:

a housing;

a pump mechanism accommodated in the housing;

an exhaust-passage forming portion located on an outer surface of the housing, wherein the exhaust-passage forming portion forms an exhaust passage, which exhaust passage guides gas discharged from the pump mechanism toward the outside of the vacuum pump, wherein the exhaust-passage forming portion includes:

a flange, which is located in an upstream section of the exhaust passage and which receives the gas discharged from the pump mechanism;

a muffler connected to the flange, wherein the gas flows from the flange to the muffler; and a thermal conductor connected to an outer surface of the flange and the muffler, wherein the thermal conductor is made of a material having a thermal conductance that is greater than that of the material for the exhaust-passage forming portion.

11. The pump according to claim 10, wherein the thermal conductor is shaped as a flat plate.

12. The pump according to claim 10, wherein the thermal conductor is formed by bending a flat plate.

13. The pump according to claim 10, wherein a thermal-conductance improver is located between the thermal conductor and the exhaust-passage forming portion.

14. The pump according to claim 10, wherein the thermal-conductance improver is located between the thermal conductor and the exhaust-passage forming portion such that a gap does not exist between the thermal conductor and the exhaust-passage forming portion.

15. The pump according to claim 14, wherein the thermal conductor extends parallel to the direction in which the exhaust passage extends, and holds the exhaust-passage forming portion.

16. The pump according to claim 10, wherein the gas is a gaseous reaction product generated in a semiconductor fabrication process.

17. The pump according to claim 10, wherein the thermal conductor is fixed to the exhaust-passage forming portion with a metal bolt.

18. The pump according to claim 10, wherein the thermal conductor abuts on an outer surface of the housing.

* * * * *